US007076849B2

(12) United States Patent
Bettencourt et al.

(10) Patent No.: US 7,076,849 B2
(45) Date of Patent: Jul. 18, 2006

(54) METHOD AND APPARATUS FOR INSTALLING A GRIP ON A GOLF CLUB SHAFT

(75) Inventors: Alan C. Bettencourt, Solana Beach, CA (US); Leo H. Guerrero, Temecula, CA (US); Lowell L. Wickett, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 195 days.

(21) Appl. No.: 10/707,253

(22) Filed: Dec. 1, 2003

(65) Prior Publication Data

US 2005/0119065 A1 Jun. 2, 2005

(51) Int. Cl.

| | |
|---|---|
| ***B23P 19/02*** | (2006.01) |
| ***B23P 11/02*** | (2006.01) |
| ***A63B 57/00*** | (2006.01) |
| ***B32B 7/12*** | (2006.01) |

(52) U.S. Cl. ..... 29/235; 29/450; 473/131; 428/355 R

(58) Field of Classification Search ..... 29/235, 29/450, 265; 473/131; 273/458, 317.3
See application file for complete search history.

(56) References Cited

U.S. PATENT DOCUMENTS

| | | | | |
|---|---|---|---|---|
| 4,043,356 | A * | 8/1977 | Morris et al. | 137/320 |
| 4,899,428 | A * | 2/1990 | Hsu | 29/235 |
| 5,281,288 | A | 1/1994 | Murray et al. | |
| 5,288,359 | A | 2/1994 | Stobbie, IV et al. | |
| 5,407,025 | A | 4/1995 | Nickel | |
| 5,429,703 | A | 7/1995 | Hartman et al. | |
| 5,429,706 | A | 7/1995 | Cresse et al. | |
| 5,609,932 | A | 3/1997 | Goetz et al. | |
| 5,629,087 | A * | 5/1997 | Hartman et al. | 428/355 AC |
| 5,741,394 | A | 4/1998 | Kennedy | |
| 5,870,815 | A | 2/1999 | Karner et al. | |
| 5,909,912 | A | 6/1999 | Mueller | |
| 6,235,134 | B1 | 5/2001 | Mueller | |
| 6,460,237 | B1 * | 10/2002 | Tsiguloff | 29/235 |

* cited by examiner

*Primary Examiner*—George Nguyen
*Assistant Examiner*—Douglas E. Mazzuca, Jr.
(74) *Attorney, Agent, or Firm*—Michael A. Catania; Elaine H. Lo

(57) ABSTRACT

A process and apparatus for installation of a handgrip on a golf club shaft is disclosed herein. The handgrip is installed on the golf club shaft wrapped in a double-sided water activated tape. The method and apparatus utilizes a minimal amount of water to provide an initial grip strength greater than 18 foot-pounds. The apparatus has a shaft retention device, a grip attachment device and a misting device.

4 Claims, 7 Drawing Sheets

METHOD AND APPARATUS FOR INSTALLING A GRIP ON A GOLF CLUB SHAFT

CROSS REFERENCE TO RELATED APPLICATIONS

Not Applicable

FEDERAL RESEARCH STATEMENT

[Not Applicable]

BACKGROUND OF INVENTION

1. Field of the Invention

The present invention relates to installation of a grip on a golf club shaft. More specifically, the present invention relates to a method and apparatus for installing a handgrip on a golf club shaft.

2. Description of the Related Art

Grips have been used on golf clubs to provide a golfer with a greater ability to grasp the golf club during a swing. Grips were used as early as the 1700s when sheep-skin grips were the choice of golfers. In the 1800s, leather grips began to appear on a golf clubs, and soon became the dominant grip. In the 1900s, numerous rubber grips were developed mainly by rubber manufacturers. Presently, grips are composed of synthetic rubbers, plastics, and the like.

Handgrips are usually placed on the butt end of a golf club shaft at the club manufacturer. This process has for the most part been a manual process, with very little automation. A golf club shaft is manually wrapped with a double-sided tape at its butt end. Next, a solvent or lubricant is sprayed into the hollow interior of the handgrip, through an open end, in order to place the handgrip over the wrapped butt end without deterring from the adhesiveness of the tape. The handgrip is pushed over the shaft until the closed end of the handgrip is flush with the butt end of the shaft. The solvent eventually evaporates, or is absorbed into the adhesive or carrier, allowing for the tape to adhere to the surface of the hollow interior of the handgrip. Thus, it is obvious that this is a highly repetitious process may lead to injuries to some laborers unless remedial steps are taken by the manufacturer. Further, the use of certain solvents and lubricants may be an environmentally unfriendly means of manufacturing. Yet further, the spraying of a solvent or lubricant is an undesirable step which increases the production time.

Other problems exist with the application of grips such as mis-alignment due to poor initial grip strength, adverse affects on swing weight due to the evaporation of excess water in water activated tapes, and long drying cycles to wait for adhesive to dry before further processing.

The golf industry, and those associated with it, have attempted to automate some of the processes to increase production and lessen injury to laborers. One example is Hsu, U.S. Pat. No. 4,899,428 (the '428 patent) for a Golf Club Handle Sleeve Assembling Mechanism. The '428 patent discloses an assembling mechanism that includes slidable tables, triple acutators with hooks for expanding the front end of the handgrip, an air blower for blowing air into the rear of the handgrip and a fluid hose for delivering a solvent or lubricant to the handgrip for facilitating insertion of the shaft into the handgrip.

Another example is Vald'via, U.S. Pat. No. 5,407,026 (the '026 patent) for a Golf Club Grip Installing Apparatus. The '026 patent discloses the use of a grip lubricating device and a golf club shaft lubricating device. The '026 patent allows for a controlled amount of lubricant to be applied for facilitated insertion of the shaft into the grip.

Another example is Cresse et al., U.S. Pat. No. 5,429,706 (the '706 patent) for a System And Method For Installing A Hollow Handgrip Over An Elongated Shaft End. The '706 discloses a system and method for applying a liquid adhesive to an interior surface of the handgrip in substitution for the use of tape on the shaft to adhere the grip. The '706 patent inflates the handgrip prior to insertion of the shaft into the grip.

Another example is U.S. Pat. No. 5,870,815 (the '815 patent) for an Apparatus And Method For Aligning A Golf Club For Attaching A Handle Grip. The '815 patent discloses an alignment assembly for positioning of a club head attached to a shaft prior to placement of a handgrip on the butt end of the shaft.

A water activated golf grip tape is disclosed in U.S. Pat. No. 5,429,703 (the '703 patent) to Hartman et al. The grip tape disclosed in the '703 patent is a four layer tape with an adhesive payer that contains moisture absorbent particles to detackify the adhesive layer for placement of a grip over the tape. The '703 patent teaches wetting the tape in a solution of soap and water in order to have the adhesive layer fully set up within twenty-four hours.

SUMMARY OF INVENTION

The present invention fulfills the needs of the golf industry by providing a novel process and apparatus for installation of a handgrip onto a golf club shaft. The present invention is able to accomplish this preferably with a moisture activated grip tape which allows for adherence of the grip to the shaft in a reduced time period.

One aspect of the present invention is an apparatus for applying a handgrip to a butt end of a golf club shaft wrapped in a double-sided water activated tape. The apparatus includes a base, a shaft retention device, a moveable attachment mechanism, a fluid source and a compressed gas source. The base has a first end and a second end. The shaft retention device has a body with an aperture therethrough for placement of a shaft therein. The shaft retention device is positioned at a first end of the base and extends outward from the base. The aperture of the body is positioned within a first horizontal plane parallel to the base. The moveable attachment mechanism includes a grip attachment device and a misting device. The grip attachment device includes a first base block, a second base block, a first guiding rod, a second guiding rod, an arm and an inflation device with a needle. The first and second base blocks connect the grip attachment device to the base and extend outward from the base. The first guiding rod is slideably positioned through an aperture in the first base block, and the second guiding rod is slideably positioned through an aperture in the second base block. The first and second guiding rods are attached to the arm. The needle is attached to the arm between the attachment of the first and second guiding rods. The misting device includes a nozzle for dispensing water onto a tape and a support structure for positioning the nozzle forward of a grip affached to the needle and in a second horizontal plane above the first horizontal plane. The water source is in flow communication with the misting device, and the compressed gas source is in flow communication with the inflation device.

Another aspect of the present invention is a process for installing a grip on a shaft, the grip having a hollow interior with a first diameter. The process includes flowing a gaseous medium into the grip to expand the hollow interior of the grip from the first diameter to a second diameter. The next, the grip is moved toward a butt end of a shaft having at least a portion wrapped in a moisture activated tape. Next, the moisture activated tape is misted with a fluid at a rate lower than 24 milliliters per minute prior to placement of the grip over the tape. Next, the expanded hollow interior of the handgrip is applied over the butt end of the golf club shaft.

Another aspect of the present invention is a golf club having a grip attached to a shaft wherein the grip has a grip strength of at least fifty-five foot-pounds, one minute after installation of the grip onto the shaft.

Another aspect of the invention is a golf club that has a gap of 0.10 inch to 0.25 inch between edges of a double-sided water activated tape, and has a grip strength of at least fifty-five foot-pounds, one minute after installation of the grip onto the shaft.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
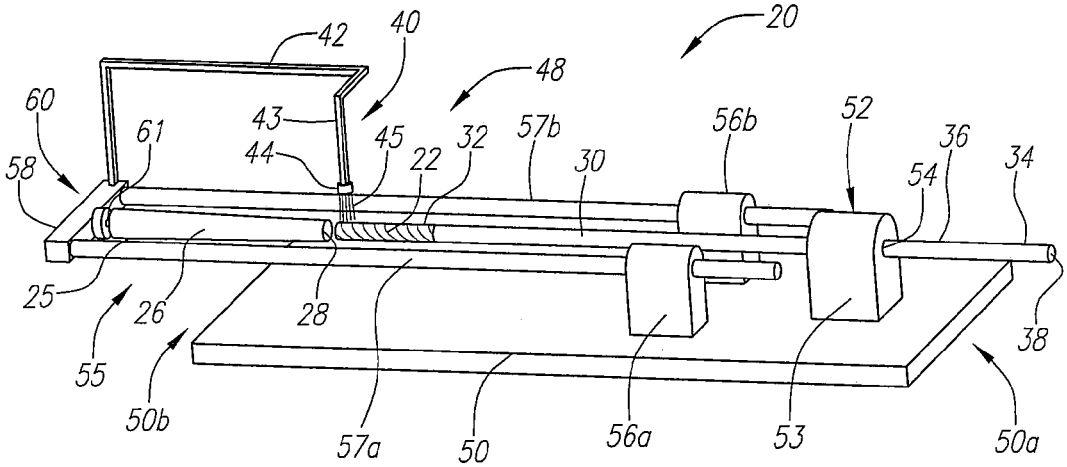
FIG. 1 a top perspective view of the automatic grip installation apparatus of the present invention with a taped shaft and grip prepared for installation.
Figure 2:
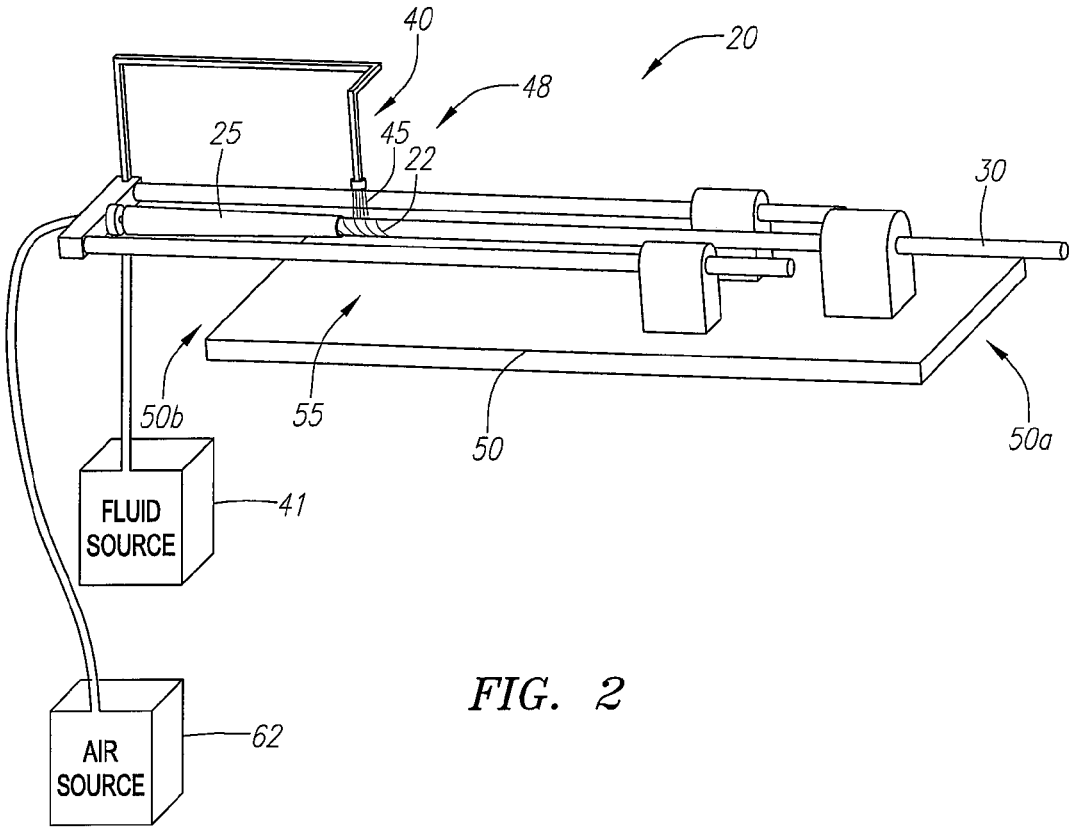
FIG. 2 is a top perspective view of grip being installed on a taped shaft using the automatic grip installation apparatus of the present invention.
Figure 3:
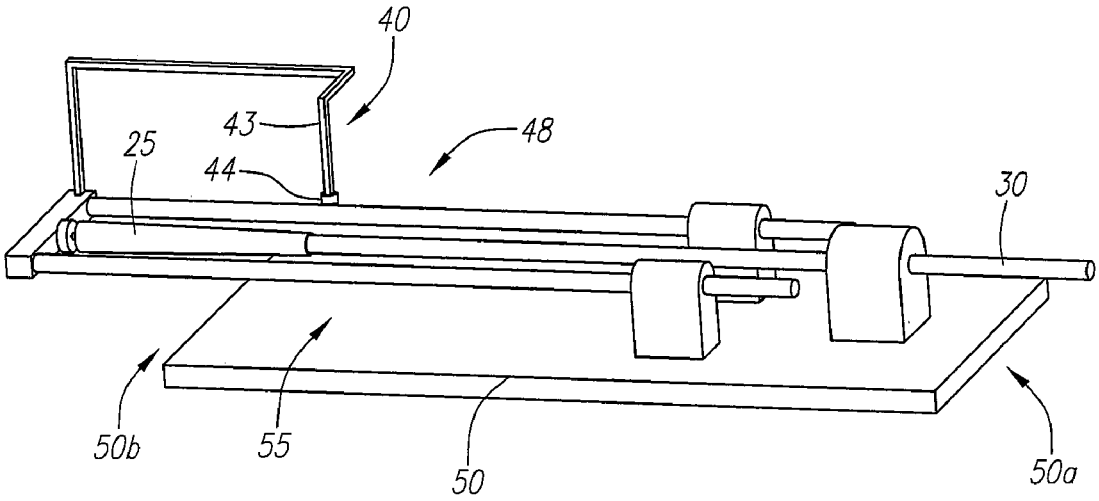
FIG. 3 is a top perspective view of the automatic grip installation apparatus with an installed grip on taped shaft.
Figure 3A:
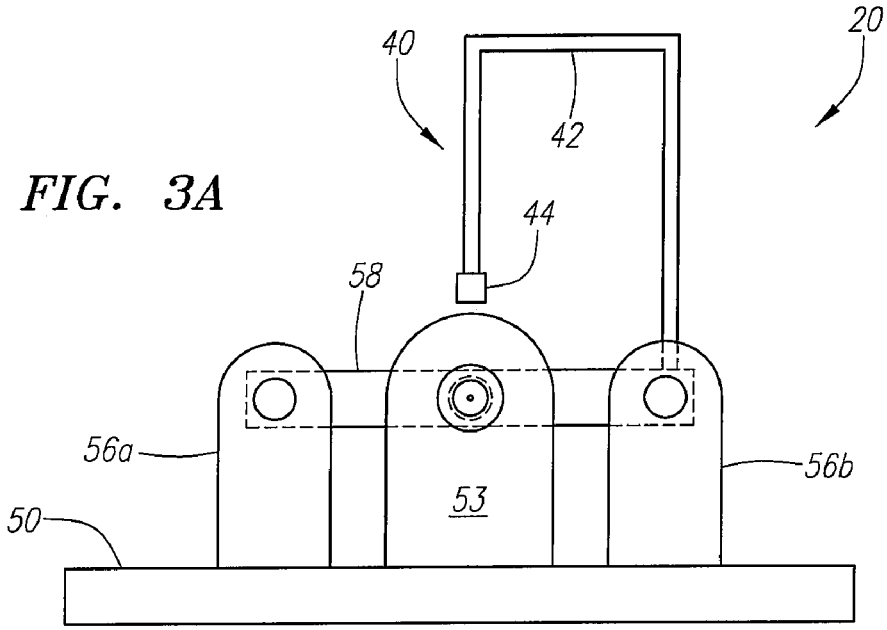
FIG. 3A is a front view of the automatic grip installation apparatus.
Figure 3B:
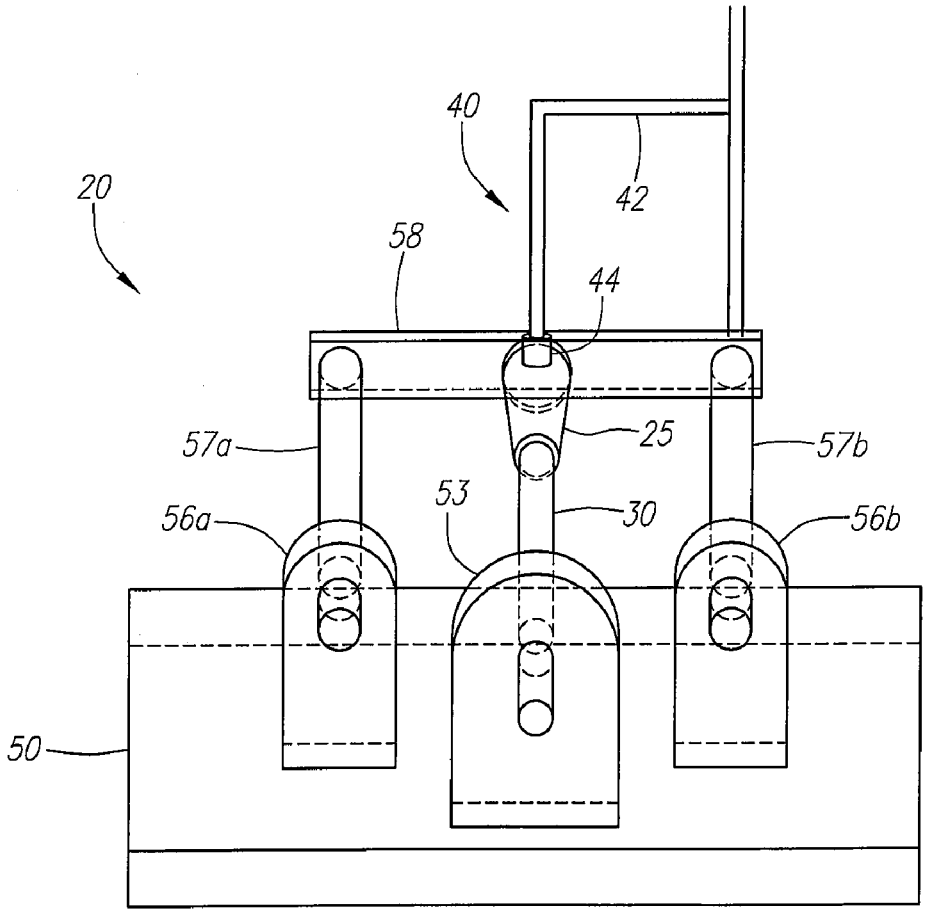
FIG. 3B is a front perspective view of the automatic grip installation apparatus.

The apparatus and method of the present invention is directed at a installing a hand grip onto a golf club shaft using a water activated double sided tape. The installation may be performed manually by an operator, or automatically using a computer controlled system. As shown in FIGS. 1-3, the grip installation apparatus of the present invention is generally designated 20. The apparatus 20 generally includes a base 50, a shaft retention device 52 and a moveable attachment mechanism 48 including a grip attachment device 55, a misting device 40 and a grip inflation device 60.

The base has a first end 50*a* and a second end 50*b* opposite the first end 50*a*. The shaft retention device 52 is generally located at a first end 50*a* of the base 50. The shaft retention device 52 preferably has a body 53 with an aperture 54 for placement of a shaft 30 therethrough. The body 53 extends upward from the base 50 and the aperture 54 preferably lies in a horizontal plane above the base 50. The shaft retention device 52 may be any fixture or means that maintains a shaft in a fixed horizontal plane.

The moveable attachment mechanism 48 provides the means for attaching the grip 25 to the butt end 32 of the shaft 30 wrapped in the double-sided water activated tape. The grip attachment device 55 generally includes a first base block 56a and a second base block 56*b* extending upward from the base. The first base block 56*a* has a first guiding rod 57*a* positioned therethrough, and the second base block 56*b* has a second guiding rod 57*b* positioned therethrough. Each of the guiding rods 57*a* and 57*b* is attached to an arm 58 at an end opposite the base blocks 56*a* and 56*b*. The arm 58 and the guiding rods 57*a* and 57*b* generally lie on the same horizontal plane with the shaft 30 placed through the aperture 54 of the shaft retention device 52. The guiding rods 57*a* and 57*b* allow for the arm 58 to move forward and rearward along the first horizontal plane in order to attach a grip 25 to a shaft 30.

The arm 58 provides a support for a needle 61 of the grip inflation device 60. The needle 61 is positioned on the arm 58 between the guiding rods 57*a* and 57*b*. The needle is in flow communication with a source of gaseous source 62 for inflating the grip 25 from a first diameter to a second diameter for installation on the shaft 30. In a preferred embodiment, the gaseous source is an air source that injects compressed air into the grip 25 through the rear aperture 29 at preferably between 20 and 75 pounds per square inch, and more preferably at least 40 pounds per square inch. The air or other gas, assists in the removal of excess fluid from the tape 22. In an alternative embodiment, the gaseous source may be blown through the tip end of a shaft without a golf club head.

The misting device 40 preferably includes a nozzle 44 attached to a support structure 42 and in flow communication with a fluid source 41 through tubing 43. The nozzle 44 lies in a second horizontal plane above the first horizontal plane. The support structure 42 is attached to the arm 58 and is moveable along with the arm 58. The nozzle 44 is positioned to be forward of the opening 28 of the grip 25. The nozzle provides a mist of the fluid onto the moisture activated tape 22 to activate the adhesive properties of the tape 22. In a preferred embodiment, the fluid 45 is water.

Figure 4:
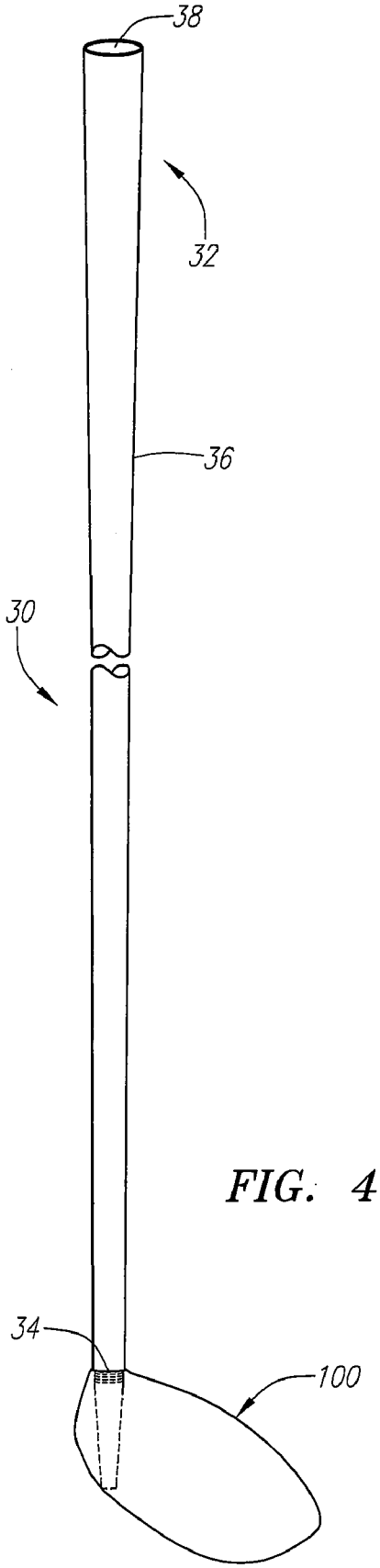
FIG. 4 is a plan view of an un-taped shaft with a club head.

As shown in FIG. 4, a shaft 40 has a golf club head 100 attached thereon at a tip end 34 of the shaft 30. The tip end 34 is inserted into a hosel of the golf club head 100. A butt end 32 of the shaft 30 has an opening to a hollow interior 38. Generally, the butt end 32 has a greater circumference than the tip end 34. The shaft 30 may be composed of a graphite material, a steel material or the like. The shaft 30 may come in various lengths depending on the golf club. The golf club may be an iron, a wood, a driver or a putter. The apparatus 20 and method of the present invention are particularly applicable to a shaft for a puffer. Although one type of shaft 30 has been illustrated and described, those skilled in the pertinent art will recognize that most if not all types of shafts may be utilized in conjunction with the present invention.

Figure 5:
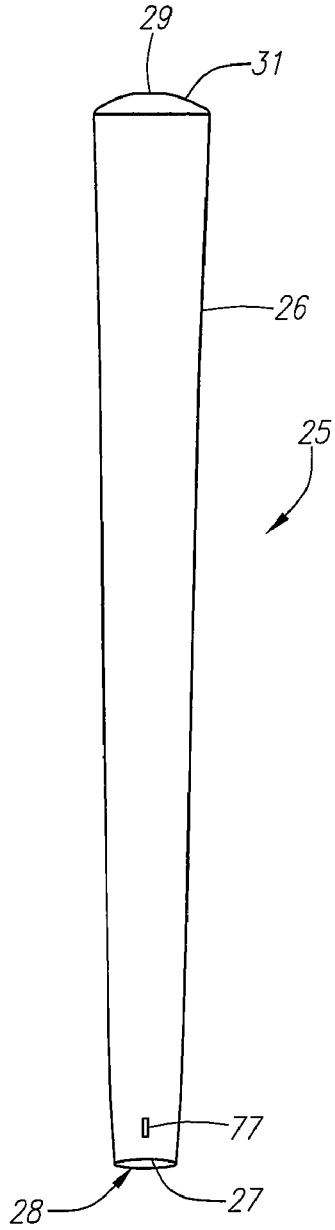
FIG. 5 is a plan view of a grip.

As shown in FIG. 5, a grip or handgrip 25 generally has a body 26 with an open end 28 that allows access to a hollow interior 27. Opposite of the open end 28 is a closed end 31 that has an aperture 29 for additional access to the hollow interior 27 of the grip 25. The body 26 of the grip 25 has an optional alignment notch 77 for proper alignment of the grip 25 on the shaft 30. Although one type of grip 25 has been illustrated and described, those skilled in the pertinent art will recognize that most if not all types of grips may be utilized in conjunction with the present invention.

Figure 6:
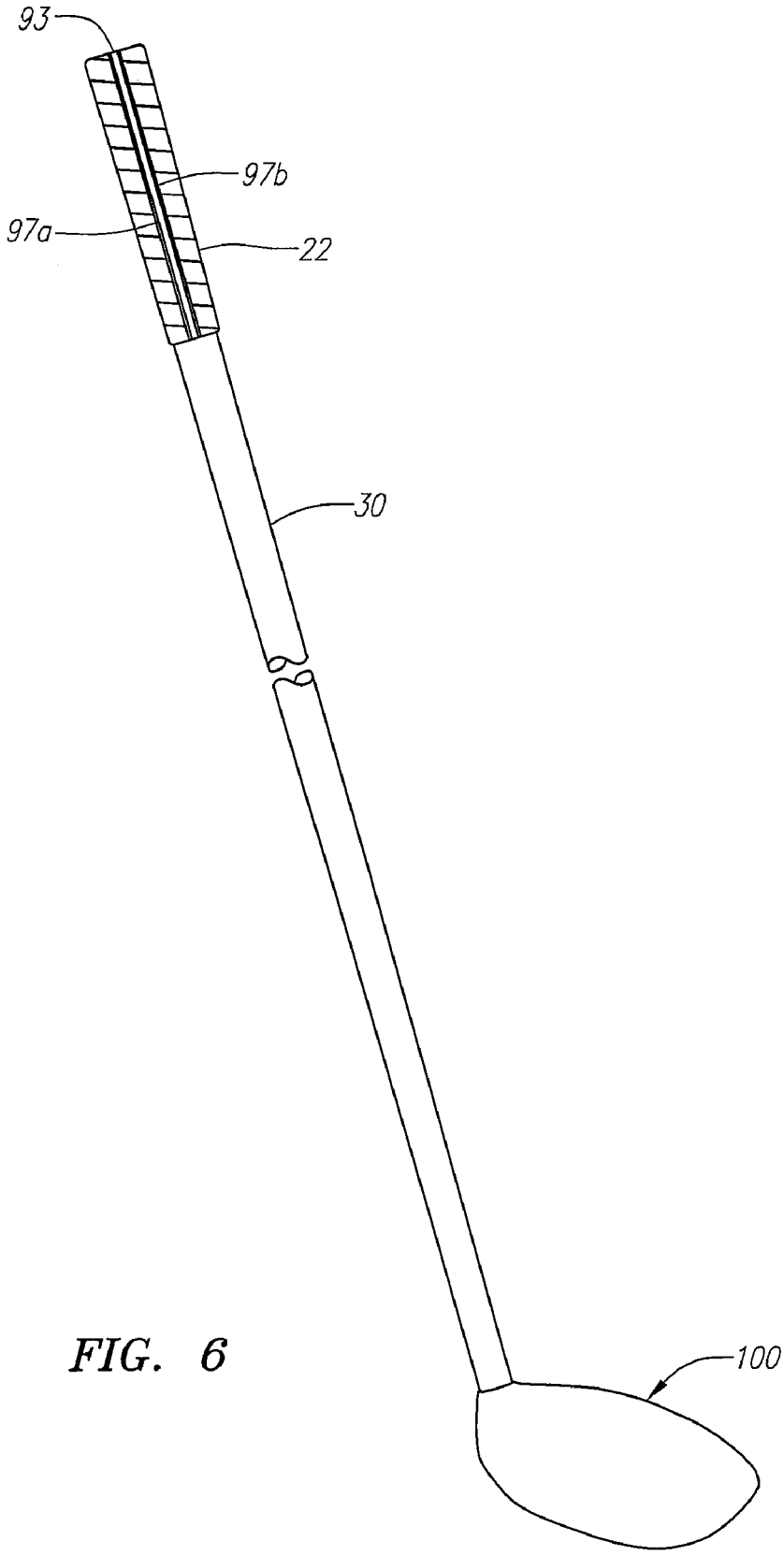
FIG. 6 is a plan view of a taped shaft with a club head.

As shown in FIG. 6, a shaft 30 with a golf club head 100 has a double-sided water based tape 22 applied to the butt end of the shaft 30. The tape 22 is preferably applied along the portion of the shaft 30 that is covered by the grip 25. In a preferred embodiment, the double-sided water based tape 22 is applied to have a gap 93 defined by tape edges 97*a* and 97*b*. The gap 93 reduces wrinkling of the tape 22 during application of the grip 25 over the tape 22. The width of the gap 93 is preferably 0.10 inch to 0.25 inch, and most preferably 0.15 inch.

Figure 7:
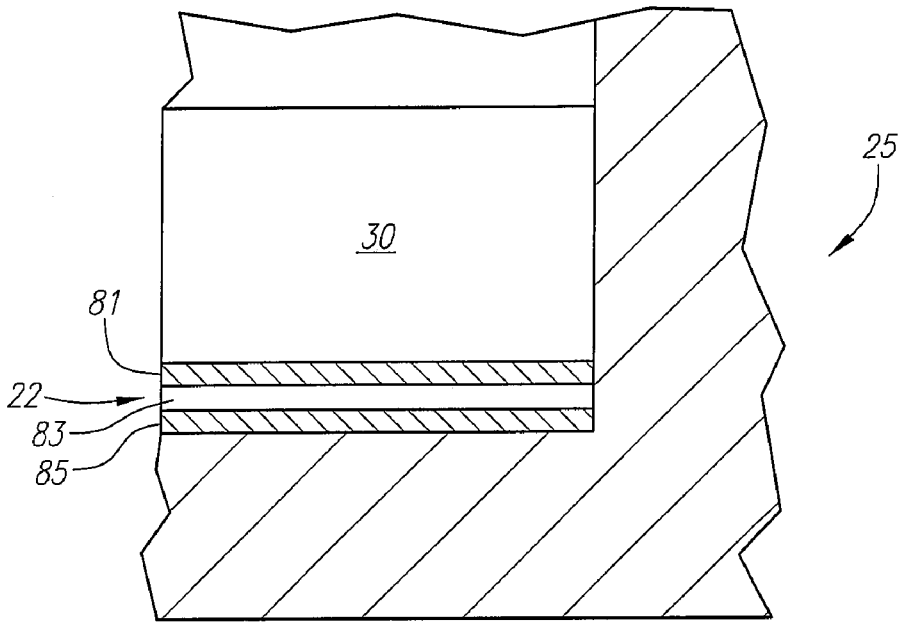
FIG. 7 is an enlarged isolated cross-sectional view of the butt end of a taped shaft with a grip installed thereon.

As shown in FIG. 7, the tape 22 preferably has three layers, an inner layer 81, a mid-layer 83 and an outer layer 85. The inner layer 81 is preferably composed of a water-based adhesive. The mid-layer 83 is a preferably a standard paper based material. The outer layer 85 is preferably composed of water-activated adhesive. A preferred tape is available from Avery Dennison.

As shown in FIGS. 1–3, a shaft 30 is placed in the aperture 54 of the shaft retention device 52 to position the shaft 30 in a first horizontal plane above the base 50 of the apparatus 20. The butt end 32 of the shaft 30 is wrapped with a double-sided water activated tape 22. The golf club head 100 may or may not be attached to the tip end 34 of the shaft 30. The grip 25 is attached to the needle 61 of the grip inflation device 60 to position the opening 28 of the grip 25 facing the taped butt end 32 of the shaft 30. The grip inflation device 60 is activated and air flows into the grip 25 through the rear aperture 29 thereby inflating the grip 25 from a first diameter to a second diameter. The misting device 40 is activated and water 45 is misted from the nozzle onto the double-sided water activated tape 22 prior to the grip 25 being moved over the butt end 32 of the shaft 30. The water or fluid 45 is misted at a rate of 2 to 30 milliliters per minute, more preferably from 8 to 15 milliliters per minute, and most preferably at approximately 11 milliliters per minute. A minimum amount of water is utilized to increase the initial grip strength of the attached grip and to reduce the adverse affects to the swing weight of the club from water evaporating. Further, the increase in initial grip strength allows for a reduction in mis-aligned grips. The shaft 30 may be rotated to mist the entire circumference of the tape 22.

Figure 9:
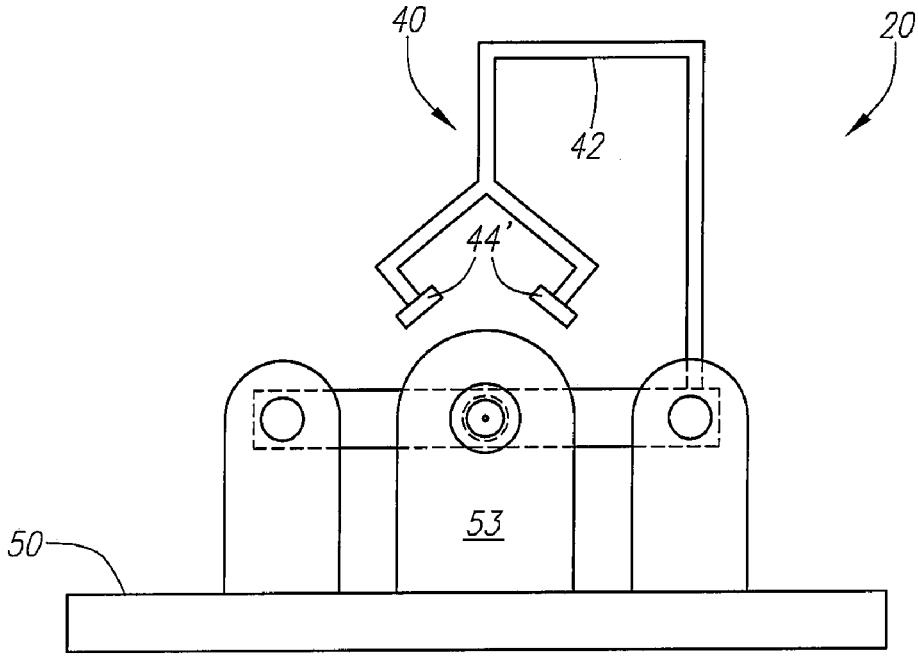
FIG. 9 is a front view of an alternative embodiment of the automatic grip installation apparatus.

In an alternative embodiment, shown in FIG. 9, the misting device 40 has a plurality of nozzles 44' for misting a fluid on the tape 22. In such an embodiment, the each of the plurality of nozzles 44' are positioned to mist the greatest area of the tape with the least amount of fluid. One such embodiment has a first nozzle 44' positioned at an angle of 45 degrees relative to the shaft 30 and a second nozzle 44' positioned at 315 degrees relative to the shaft 30.

As shown in FIG. 2, the grip 25 is covering a portion of the tape 22 on the butt end 32 of the shaft 30. As the moveable attachment mechanism 48 moves the grip 25 over the butt end 32 of the shaft 30, the tape 22 forward of the opening 28 of the grip 25 is activated by the water from the nozzle 44 of the misting device 40. As the grip 25 is applied over the tape 22, excess water is forced out of the tape 22 by the pressure of the grip 25 and the air flowing through the grip 25, thereby increasing initial grip strength.

As shown in FIG. 3, the grip 25 is fully placed on the butt end 32 of the shaft 30 and the misting device 40 and the grip inflation device 60 are deactivated. The gripped shaft 30 is removed from the shaft retention device 52 and the needle 61 is removed from the rear aperture 29 of the grip. The gripped shaft 30 is then removed from the apparatus 20.

Figure 8:
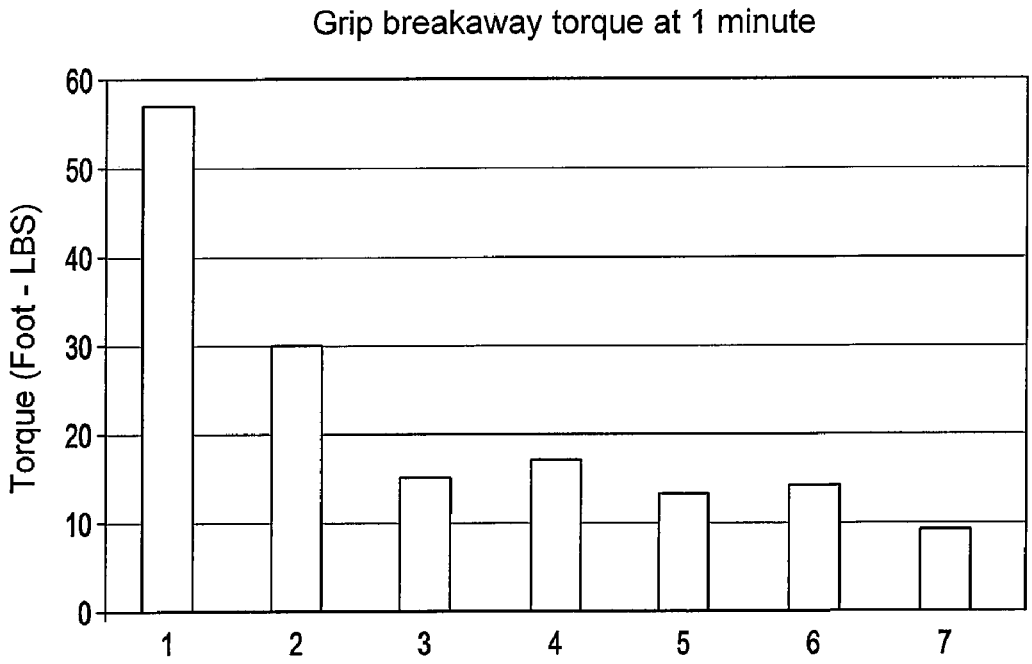
FIG. 8 is a bar graph of the grip strength of attached grips after one minute.

As shown in FIG. 8, the grip 25 attached to a shaft 30 according to the method and apparatus of the present invention has a grip strength (torque) that is stronger than the prior art. The torque of grips 25 attached to shafts according to the present invention were compared to grips attached according to conventional methods. Examples 1 and 2 followed the teachings of the present invention. Example 1 had the water misted at a rate of 11 milliliters per minute. Example 2 had the water misted at a rate of 24 milliliters per minute. Comparative example 3 mixed water and soap (17 ml) without compressed air, and the water and soap mixture was poured into the grip and onto the tape. Comparative example 4 was only water (17 ml) poured on the tape with the grip staying dry, and compressed air was flowed through the grip. Comparative example 5 was water and soap (17 ml) poured into the grip and on the tape with compressed air flowed through the grip. Comparative example 6 was water (17 ml) poured into the grip and on the tape with compressed air flowing through the grip. Comparative example 7 was the solvent oxsol (17 ml) poured into the grip and on the tape. Comparative example 7 is the most used process in the industry at this time. The torque necessary to breakaway the grip 25 from the shaft 30 was measured after one minute. The grip 25 attached to the shaft 30 according to the present invention had a grip strength or torque of greater than 18 foot-pounds after one minute of installation of the grip 25 on the shaft 30. More specifically, in example 2, the attached grip 25 had a grip strength or torque of 30 foot-pounds, and the attached grip 25 of example 1 had a grip strength or torque of 55 foot-pounds. Thus, the invention allows for an initial grip strength of between 18 to 100 foot pounds, and more preferably 20 to 60 foot-pounds.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An apparatus for applying a grip to a butt end of a golf club shaft wrapped in a double-sided water activated tape, the apparatus comprising:

a base having a first end and a second end;

a shaft retention device having a body with an aperture therethrough for placement of a shaft therein, the shaft retention device positioned at a first end of the base, the shaft retention device extending outward from the base, the aperture of the body positioned within a first horizontal plane parallel to the base;

a moveable attachment mechanism, the moveable attachment comprising:

a grip attachment device comprising a first base block, a second base block, a first guiding rod, a second guiding rod, an arm and an inflation device with a needle, the first and second base blocks extending outward from the base, the first guiding rod slideably positioned through an aperture in the first base block, the second guiding rod slideably positioned through an aperture in the second base block, the first and second guiding rods attached to the arm, the needle attached to the arm between the attachment of the first and second guiding rods such that the needle and the first and second guiding rods extend in the first horizontal plane, the needle adapted to be inserted into an aperture in a closed end of the grip, the needle supporting the grip on the moveable attachment mechanism and positioning an open end of the grip facing the butt end of the golf club shaft; and a misting device comprising a nozzle for dispensing water onto a tape on the golf club shaft and a support section for positioning the nozzle forward of a grip attached to the needle and in a second horizontal plane above the first horizontal plane;

a water source in flow communication with the misting device; and a source of compressed air in flow communication with the inflation device.

2. The apparatus according to claim 1 wherein the arm and the misting device move simultaneously from the second end of the base toward the first end.

3. The apparatus according to claim 1 wherein the misting device dispenses water from the nozzle at a rate of at least eleven milliliters per minute.

4. The apparatus according to claim 1 wherein the inflation device provides compressed air at least forty pounds per square inch.

* * * * *